US012577491B2

(12) United States Patent
Fries et al.

(10) Patent No.: US 12,577,491 B2
(45) Date of Patent: Mar. 17, 2026

(54) BASE OIL AND LUBRICATING FLUID COMPOSITION CONTAINING SAID BASE OIL

(71) Applicant: FUCHS SE, Mannheim (DE)

(72) Inventors: Patrick Fries, Kaiserslautern (DE); Olaf Binkle, Kirkel (DE)

(73) Assignee: FUCHS SE, Mannheim (DE)

( * ) Notice: Subject to any disclaimer, the term of this patent is extended or adjusted under 35 U.S.C. 154(b) by 0 days.

(21) Appl. No.: 18/864,422

(22) PCT Filed: Mar. 23, 2023

(86) PCT No.: PCT/DE2023/100225
§ 371 (c)(1),
(2) Date: Nov. 8, 2024

(87) PCT Pub. No.: WO2023/217313
PCT Pub. Date: Nov. 16, 2023

(65) Prior Publication Data

US 2025/0304873 A1 Oct. 2, 2025

(30) Foreign Application Priority Data

May 11, 2022 (DE) ..... 102022111794.4

(51) Int. Cl.

| | |
|---|---|
| ***C10M 107/02*** | (2006.01) |
| ***C10M 107/24*** | (2006.01) |
| ***C10M 107/32*** | (2006.01) |
| ***C10M 137/08*** | (2006.01) |
| *C10M 111/04* | (2006.01) |
| *C10N 20/02* | (2006.01) |
| *C10N 20/04* | (2006.01) |
| *C10N 40/04* | (2006.01) |

(52) U.S. Cl.
CPC ..... *C10M 107/02* (2013.01); *C10M 107/24* (2013.01); *C10M 107/32* (2013.01); *C10M 137/08* (2013.01); *C10M 111/04* (2013.01); *C10M 2205/0206* (2013.01); *C10M 2209/043* (2013.01); *C10M 2209/1023* (2013.01); *C10M 2223/043* (2013.01); *C10N 2020/02* (2013.01); *C10N 2020/04* (2013.01); *C10N 2040/04* (2013.01)

(58) Field of Classification Search
CPC ..... C10M 107/02; C10M 107/24; C10M 107/32; C10M 137/08; C10M 111/04; C10M 2205/0206; C10M 2209/043; C10M 2209/1023; C10M 2223/043; C10N 2020/02; C10N 2020/04; C10N 2040/04
See application file for complete search history.

(56) References Cited

U.S. PATENT DOCUMENTS

| | | | | |
|---|---|---|---|---|
| 5,435,928 | A * | 7/1995 | Beck | B29C 33/62 560/190 |
| 6,824,671 | B2 * | 11/2004 | Goze | C10M 109/02 208/19 |
| 2008/0125338 | A1 * | 5/2008 | Corbett | C10M 169/00 508/436 |
| 2008/0312113 | A1 * | 12/2008 | Beatty | C10M 169/044 508/579 |
| 2015/0353861 | A1 * | 12/2015 | Lee | C10M 169/042 508/459 |
| 2018/0148661 | A1 * | 5/2018 | Lee | C10M 137/10 |
| 2018/0245016 | A1 * | 8/2018 | Greaves | C10M 169/04 |
| 2021/0348079 | A1 | 11/2021 | Garcia Castro et al. | |
| 2022/0213400 | A1 * | 7/2022 | Forbus, Jr. | C10M 105/38 |
| 2025/0084338 | A1 * | 3/2025 | Forbus, Jr. | C10M 145/38 |

FOREIGN PATENT DOCUMENTS

| | | | |
|---|---|---|---|
| DE | 102020111392 | A1 | 10/2021 |
| EP | 2006365 | A2 | 12/2008 |
| JP | 2007268697 | A | 10/2007 |
| WO | 2013123160 | A1 | 8/2013 |
| WO | 2021219455 | A1 | 11/2021 |

OTHER PUBLICATIONS

Italmatch Chemicals, "KETJENLUBE 240 Applications—Performance Examples" Apr. 1, 2013.
Product information "Lubricant & Specialty Chemicals", Italmatch, 2010.
Handbook of Maleic Anhydride Based Materials, O. Musa, Springer 2016.
Synthetics, Mineral Oils and Bio-Based Lubricants, Rudnick 2020.
UCONTM Base Fluids, Produktionformation von Dow Chemicals, 2013.
Spikes, H. "Friction Modifier Additives", 2015, Tribol. Lett., 60:5.
Produktinformation Synfluid Polyalfaolefins (PA), Chevron Philips (Safe Handling and Storage of Synfluid® Polyalphaolefins (PAO); 2022.

(Continued)

*Primary Examiner* — Ellen M McAvoy
(74) *Attorney, Agent, or Firm* — D'Ambrosio & Menon, PLLC; Usha Menon

(57) ABSTRACT

The invention relates to a base oil comprising polyalphaolefins, polymer esters and polyalkylene glycols and a lubricating fluid composition containing the base oil. The lubricating fluid composition can be used for the lubrication of transmission and for use in hydraulic systems, in particular for lubrication in the food preparation industry.

17 Claims, No Drawings

(56) References Cited

OTHER PUBLICATIONS

Synthetic Lubricants and High-Performance Functional Fluids, R. 1993.
Datenblatt Irgalube 349® von BASF; 2016.
Sicherheitsdatenblatt DURASYN® 166 POLYALPHAOLEFINS von INEOS. Jun. 2009.
High Performance Chemicals for Lubricants, Italmatch Chemicals, Dec. 2016.
Data Sheet "Ketjenlube" 135, Italmatch Chemicals, Jan. 2006.
Chemical Book, Eintrag CAS 128218-63-3; 2024.
Data Sheet "Durasyn 166 Polyalphaolefin", Ineos Oligomers; 11.22. 2024.
Erklärung, mit Anlagen A bis D (Declaration with attachments A to D); 2024.
Safety Data Sheet, Lubizol VL 1200H, Version 2.1., Revision Date: Aug. 28, 2023.

* cited by examiner

BASE OIL AND LUBRICATING FLUID COMPOSITION CONTAINING SAID BASE OIL

The present invention relates to a base oil comprising polyalphaolefins, polymer esters, and polyalkylene glycols and a lubricating fluid composition comprising the base oil and additives. The lubricating fluid composition can be used for the lubrication of gears (transmissions) and for use in hydraulic systems, in particular for lubrication in the food processing industry. A particular field of application of the base oils and lubricating fluid compositions according to the invention are lubrication points that come or may come into contact with foodstuffs and/or animal feedstuff.

INTRODUCTION AND STATE OF THE ART

Hydraulic and gear oils consist of a base oil and additives that are added to increase the service life and performance of the lubricating fluid. The base oil can consist of a mixture of different oils.

Various mechanical-dynamic tests are carried out to determine the performance of a lubricating fluid. The Forschungsstelle für Zahnräder und Getriebebau" (Research Centre for Gears and Transmission Engineering") (FZG) at the Technical University of Munich (FZG) has developed a test rig that can be used to test gear lubricants for their suitability to prevent the surfaces and flanks of gears from seizing. An important parameter for industrial gear oils is the damage force level in the FZG test A/8.3/90 in accordance with DIN ISO 14635-1. In this test, the scuffing load capacity of lubricants is determined using an FZG gear tension test machine. For this purpose, a pair of test gears with a special tooth geometry runs in the lubricating fluid to be tested. Temperature and speed are specified. The load on the tooth flanks is applied in stages via a lever loaded with weights, which braces one of the shafts against the other. From force level 4, the pinion tooth flanks are inspected for any damage after the end of each force level. If force level 12 is reached without damage occurring, the measurement is completed. The requirement standard for hydraulic oil (DIN 51524-2 HLP) requires at least force level 10, while the requirement standard for circulating oils (DIN 51517-3 CLP) requires at least force level 12. The result is either "pass" or "fail"-works or does not work.

Another technically relevant requirement that goes beyond DIN 51517-3 is high grey staining resistance. The term "grey staining resistance" refers to the ability of a lubricating fluid to prevent the damage caused by grey staining (also known as "micropitting").

Grey staining occurs on tooth flanks under high loads in the area of mixed friction. The lubricating film thickness at operating temperature has a primary influence on the occurrence of grey staining. In addition, the use of chemically active additives can significantly favour the occurrence of grey staining. The addition of friction-improving additives (friction modifiers) can help to prevent grey staining. U.S. Pat. No. 9,347,016 B2 describes the use of a dialkyl dithiophosphate as an effective component against micropitting. EP 0949320 A2 mentions phosphonates and phosphites (e.g. dioleyl phosphite), succinimides, pyrrolidinones, molybdenum carboxylates and oleylamide as friction modifiers for preventing micropitting. U.S. Pat. No. 6,184,186 B1 claims the use of molybdenum carboxylates and sulphurised isobutylenes to prevent micropitting.

The FVA 54 micropitting test, which is carried out on an FZG standard tensioning test machine, is used to determine the micropitting resistance of a lubricating fluid. This test consists of two consecutive parts: A step test to determine the damage force level and an endurance test to assess the tribological long-term behaviour. In the step test, the load is gradually increased from force level 5 to force level 10, with the test duration for each force level being 16 hours. The endurance test initially runs for 80 h at force level 8 and then 5×80 h at force level 10. After each force level, the pinion is removed and the profile form deviation and the proportion of grey stains on the tooth flank are determined on three teeth. In addition, the weight loss of the pinion caused by wear is determined. The profile form deviation is used to determine the damage force level in the profile form deviation is used. If a value of 7.5 μm is exceeded, the damage force level is reached. If the limit value is not exceeded after the first five force levels, damage force level 10 is reached. If all six force levels are passed through without exceeding the limit value, the result is given as SKS greater than 10.

Elastomer compatibility is also important in practice, as elastomers, e.g. radial shaft seals, can shrink and lead to leaks if the oil is used for a long time. Similarly, an oil can cause excessive swelling, which can also lead to leaks. Various types of NBR and FKM elastomers are generally used in industrial gearboxes, whereby the NBR types in particular react strongly to the composition of the base oil mixture.

For the lubrication of industrial gearboxes in the food processing industry, lubricating fluids that are physiologically non-hazardous must be used, as possible contact of the lubricating fluid with the food cannot be completely ruled out. The selection of raw materials that can be used for the production of lubricating fluids suitable for food (food grade (H1)) is very limited for technical lubricating fluids. None of the friction modifiers mentioned above are permitted for the formulation of "food grade" lubricating fluids.

The requirements for a hydraulic oil for industrial use are described in DIN 51524-1, DIN 51524-2 and DIN 51524-3. Hydraulic oils offer protection against wear and corrosion, whereby the wear protection of HLP-classified oils (DIN 51524-2) is improved compared to HL oils (DIN 51524-1) and HVLP-classified oils (DIN 51524-3) have a more stable temperature-viscosity behaviour (viscosity index) in addition to the improved wear protection and can therefore be used in a wider temperature range.

A high viscosity index is also desirable. Pressure losses in hydraulic systems reduce efficiency. These can occur at low temperatures due to an increase in the viscosity of the fluid and at high temperatures due to leakage caused by a decrease in the viscosity of the fluid. A high efficiency factor over a wide temperature range can therefore be achieved with oils with a high viscosity index.

In the past, highly refined white oils, gas-to-liquid (GTL) oils, polyalphaolefins, polyisobutylenes, polyalkylene glycols, alkylated naphthalenes, native and synthetic esters as well as mixtures of these components have been discussed as base oils for "food-grade" hydraulic and gear oils.

US 2021/0348079 A discloses lubricants based on a terpolymer of diester, olefin, and acrylate. The terpolymer is a polymerised diester selected from a di(C4-C22-alkyl)ester of maleic acid, fumaric acid, 2-methylmaleic acid, 2,3-dimethylmaleic acid, 2-methylfumaric acid, 2,3-dimethylfumaric acid or mixtures as polymerisation product with a C6-C40-alpha-olefin and a C4-C40-alkyl (meth)acrylate. Polyalphaolefins or alkylene oxides, among others, are proposed as optional base oils for the lubricant.

JP 2007-268697 A discloses oil compositions based on Fischer-Tropsch hydrocarbons and n-paraffins, and optionally aromatic and napthalene hydrocarbon oils. The oil compositions may optionally further contain synthetic oils such as poly-alpha-olefins or polyalkylene glycols or polymers, such as polymerisation products of unsaturated carboxylic acid residues such as maleic acid ester or fumaric acid ester polymers polymerised with an olefinic monomer.

OBJECT OF THE INVENTION

The object of the invention is to provide a base oil and a lubricating fluid containing the base oil, wherein the lubricating fluid is to be usable, inter alia, as a gear oil and/or as a hydraulic oil. The base oil should be such that it can take the additives required for the lubricating fluid and the additives in the base oil have the desired effect. According to one embodiment, the raw materials should be selected in such a way that the lubricating fluids can also be used in the food processing industry. The selection of raw materials is regulated in the U.S.A., for example, by the specifications of the U.S. Food and Drug Administration (FDA). As a gear oil, the lubricant fluid should fulfill the CLP standard DIN 51517-3 according to one design and, in addition, have a micropitting test according to FVA 54 with a "high" level of grey staining resistance, particularly from viscosity grade 220 (ISO VG 220). In order to be used as a hydraulic oil, low viscosity classes of the lubricating fluid should also fulfil DIN 51524-3 (HVLP). In all viscosity classes, good compatibility with common NBR elastomers (NBR is the abbreviation for "nitrile butadiene rubber") and fluorinated rubber elastomers (FKM elastomers) is desired.

SUMMARY OF THE INVENTION

The problem is solved by the object of the independent claims. Advantageous embodiments are the subject of the subclaims or are described below.

The base oil according to the invention comprises:

50-98 wt. %, preferably 81 to 96 wt. %, of polyalphaolefins as oligomers of C6 to C14 alpha-olefins, in particular C8- to C12-alpha-olefins;

1-25 wt. %, preferably 2 to 15 wt. %, of polymer esters obtainable as a polymerisation product of one or more alpha/beta-unsaturated dicarboxylic acid diesters, the alcohol groups having 3 to 10 carbon atoms, in particular 4 to 8 carbon atoms, with one or more C4- to C18-alpha-olefins, in particular C10- to C16-alpha-olefins or C12- to C16-alpha-olefins;

1-25 wt. %, preferably 2 to 4 wt. %, polyalkylene glycols obtainable from alkylene oxides, wherein the alkylene oxides comprise butylene oxide or propylene oxide and at least one C4 to C8 alkylene oxide.

According to another embodiment, the base oil comprises 81-96 wt. % of the above polyalphaolefins;

2-15 wt. % of the above polymer esters;

2-4 wt. % of the above polyalkylene glycols.

According to another embodiment, the above polyalphaolefins, polymer esters and polyalkylene glycols together make up more than 90 wt. %, in particular more than 95 wt. % of the base oil. Preferably, the above polyalphaolefins, polymer esters and polyalkylene glycols add up to 100 wt. % in the base oil. The base oil then consists of the above components.

According to one embodiment, the polyalphaolefin is an oligomer of a 1-octene, -1-decene and/or 1-dodecene, and in particular an oligomer of 1-octene or 1-decene or 1-octene and 1-decene. The degree of polymerisation of the polyalphaolefins can be 3 to 25.

Also irrespective of this, the viscosity of the polyalphaolefins is preferably between 4 and 300 $mm^2/s$ at 100° C. (kinematic viscosity determined according to DIN EN ISO 3104). The polyalphaolefins can also be used as hydrogenated products.

The polymer esters are preferably copolymers of maleic acid and/or fumaric acid (full/completely esterified) esters and one or more C4 to C18 alpha-olefins. The alcohol groups of the dicarboxylic acid diesters are in particular linear and/or branched monoalcohols with 3 to 10 carbon atoms, in particular 4 to 8 carbon atoms. The dicarboxylic acids of the dicarboxylic acid diester preferably have 4 to 12 carbon atoms, in particular 4 to 6 carbon atoms. Chain lengths of 10 to 16 carbon atoms, in particular 14 to 16 carbon atoms, are preferred for the alpha-olefins of the polymer esters. These can be linear and/or branched, preferably linear. The molar ratio of the alpha-olefins to the dicarboxylic acid diesters can be 1.5:1 to 1:1.5, in particular 1:0.9 to 0.9:1. The polymer esters have in particular an average molecular weight of 1000 to 5000 g/mol and in particular 1500 to 2500 g/mol (in each case as number average).

The molar ratio of the alpha-olefins to the dicarboxylic acid diesters can be 1.5:1 to 1:1.5, in particular 1:0.9 to 0.9:1.

According to one embodiment, the polyalkylene glycols comprise 30-70 mol % propylene oxide and 70-30 mol % C4- to C8-alkylene oxides, in particular butylene oxide, or in particular consist of these. The polyalkylene glycols are preferably soluble at room temperature in the polyalphaolefins or polyalphaolefin mixtures with which they are used.

The lubricating fluid composition comprising the base oil according to at least one of the preceding claims, and at least one of the following additives amine-reacted alkyl phosphate and/or polyol monoester.

The lubricating fluid composition preferably comprises or consists of at least:

90 to 98 wt. % of the base oil;

0.01 to 2 wt. %, preferably 0.1 to 0.3 wt. %, of the friction modifier mentioned below, and/or 0.01 to 2 wt. %, preferably 0.05 to 0.6 wt. %, of the anti-wear additive mentioned below, based on the base oil; and other additives, in particular 0.1 to 2 wt. % of the other additives.

According to one embodiment, the lubricating fluid composition comprises or consists of:

94 to 98 wt. % of the base oil;

0.01 to 2 wt. %, preferably 0.1 to 0.3 wt. %, of the friction modifier mentioned below, and/or 0.01 to 2 wt. %, preferably 0.05 to 0.6 wt. %, of the aforementioned anti-wear additive, based on the base oil;

other additives, in particular 0.1 to 2 wt. % of the other additives.

The lubricating fluid composition comprises the base oil and at least one of the following additives:

an amine-reacted alkyl phosphate, in particular mono- or di-C1- to C12-alkyl phosphate, as an anti-wear additive, in particular 0.01 to 2 wt. %, preferably 0.1 to 0.6 wt. % and/or a polyol monoester, in particular a C12- to C24-fatty acid ester of optionally ethoxylated polyols, in particular optionally ethoxylated sorbitan monooleate, as friction modifier, in particular 0.01 to 2 wt. %, preferably 0.05 to 0.3 wt. % in each case.

The amine-reacted alkyl phosphate is preferably a mono- or di-C1- to C12-alkyl phosphate reacted with at least C10- to C18-alkylamines. Preferably, the reaction is carried out in such a way that the alkyl phosphate is neutralised or partially neutralised. Suitable examples are mono- and diisooctyl esters of phosphoric acid reacted with tert-alkylamines and C12- to C14-primary amines (CAS Reg. No. 68187-67-7) or phosphoric acid mono- and di-hexyl esters reacted with tetra-methylnonylamine and C11- to C14-alkylamines.

Commercial products are e.g. Irgalube® 349 from BASF SE or Additin® RC 3760 from LANXESS (CAS Reg. No. 80939-62-4). The amine-reacted alkyl phosphate is an anti-wear additive.

The polyol monoester is preferably a C12- to C24-fatty acid ester of polyols such as glycerol, polyglycerol or sorbitan. The polylol may also be wholly or partially ethoxylated. Suitable examples are polysorbate 20, polysorbate 40, polysorbate 60, polysorbate 120, glyceryl monostearate, glyceryl monooleate, sorbitan monolaurate, sorbitan monopalmitate, sorbitan monostearate, sorbitan monooleate or polyglyceryl 4-isostearate.

The C12- to C24-mono fatty acid esters of optionally partially ethoxylated polyols act as friction modifiers.

The base oil in a lubricating fluid composition or the lubricating fluid composition can be used as hydraulic and gear oil, in particular in the food processing industry and/or the feedstuff processing industry.

The percentages by weight refer to the total composition (unless expressly stated otherwise) and apply independently of each other.

The above polyalphaolefins, polymer esters and polyalkylene glycols are not chemically pure products and if they are mentioned in the singular, this also means a mixture of different molecules, each of which individually corresponds to the stated specification.

DETAILED DESCRIPTION OF THE INVENTION

Hydraulic and gear oils consist of a base oil and additives that are added to increase the service life and performance of the lubricating fluid. The base oil used in the present invention is a mixture of the above polyalphaolefins, polymer esters and polyalkylene glycols.

The polyalphaolefins are oligomers of, in particular, linear 1-alkenes, especially 1-octene, 1-decene and/or 1-dodecene, which are produced, for example, using Lewis acid catalysts (e.g. U.S. Pat. No. 6,824,671 B2) or metallocene catalysts (mPAOs, U.S. Pat. Nos. 9,365,663 B2, 9,701,595 B2) and whose kinematic viscosity at 100° C. (kV 100) can be between 2 and 300 $mm^2/s$ The polyalphaolefin can be, for example, an oligomer of 50 to 80 wt. % of 1-decene and 50 to 20 wt. % of 1-dodecene.

According to one embodiment, the polyalphaolefins are a mixture of a1) oligomers of 1-decene and b1) oligomers of 1-octene or a mixture of a2) oligomers of 1-dodecene and b2) oligomers of 1-octene and/or 1-decene. These mixtures can be characterised in more detail as follows: 5-95 wt. % of oligomers a1) or a2) and 5 to 95 wt. % of oligomers b1) or b2). The polyalphaolefins may be prepared by metallocene catalysis.

It is often advantageous to mix polyalphaolefins with different viscosities, e.g. oligomers with a viscosity of 4 to 100 $mm^2/s$ at 100° C. and oligomers with a viscosity of 50 to 300 $mm^2/s$ at 100° C.

Polymer esters are polymers resulting from C,C-linkage that contain side chains with ester groups. These include, in particular, the copolymers of alpha, beta unsaturated dicarboxylic acid esters, such as maleic or fumaric acid esters with, in particular, unbranched alpha-olefins. Polymer esters and their production are described, for example, in DE 3223694 C2 and U.S. Pat. No. 5,435,928 A.

The polyalkylene glycols are the polymeric reaction products of water and/or a monohydric or dihydric starting alcohol with 1,2-epoxides such as ethylene oxide, propylene oxide and/or butylene oxide, comprising at least propylene oxide and at least one C4 to C8 alkylene oxide. The polyalkylene glycols are present, for example, as homopolymers of butylene oxide or as copolymers of propylene oxide and butylene oxide. Copolymers consisting of 30-70% propylene oxide and 70-30% butylene oxide are preferably used in the present case. The polyalkylene glycols have in particular one or two terminal hydroxyl groups.

For elastomer compatibility, the addition of a swelling agent in the lubricating fluid composition, typically an ester, is desirable. Similarly, too high a content of swelling agent leads to excessive swelling, which can also lead to leakage.

Various NBR and FKM elastomer types are used in industrial gearboxes, whereby the NBR types in particular respond strongly to the composition, i.e. the polarity of the base oil mixture.

Examples of swelling agents are monoesters, diesters, polyol esters and complex esters, e.g. of C1- to C18-alcohols with a C2- to C18-carboxylic acid. The monoesters and diesters in question here include the esters of linear or branched monohydric alcohols such as methanol, ethanol, isopropanol, isobutanol, 2-ethylhexanol, 3,5,5-trimethylhexanol or 7-methyloctanol with typical fatty acids or dicarboxylic acids, such as caprylic acid, capric acid, lauric acid, myristic acid, palmitic acid, stearic acid, isostearic acid, oleic acid, linoleic acid, linolenic acid, adipic acid, suberic acid, sebacic acid or phthalic acid. Polylol esters include the formal reaction products of linear or branched carboxylic acids with polyhydric alcohols such as glycerol, neopentylglycol, trimethylolpropane, pentaerythritol or dipentaerythritol. The proportion of swelling agent is selected in such a way that the elastomer does not expand by more than 10% in volume. As a rule, this means that the swelling agent is present in the lubricating fluid composition in a proportion of 0.5 to 6 wt. %, in particular 1 to 4 wt. %. One example is di(2-ethylhexyl)sebacate. However, it was found that the polyalkylene glycol used also acts as a swelling agent.

Other possible additives for the lubricating fluid composition are antioxidants, anti-wear agents, anti-corrosion agents, detergents, colourants, friction reducers, viscosity improvers, high-pressure additives, metal deactivators and nanoscale solids. Examples include:

primary antioxidants such as amine compounds (e.g. alkylamines or 1-phenylaminonaphthalene), aromatic amines such as phenylnaphthylamines or diphenylamines or polymeric hydroxyquinolines (e.g. TMQ), phenol compounds (e.g. 2,6-di-tert-butyl-4-methylphenol), organic dithiocarbamates or dithiophosphates;

secondary antioxidants such as phosphites, e.g. tris(2,4-ditert-butylphenylphosphite) or bis(2,4-ditert-butylphenyl)-pentaerythritol diphosphite or thioethers (e.g. cresol thioethers);

high-pressure additives and/or anti-wear additives such as organic sulphur compounds such as polysulphides or sulphurised olefins, thiophosphates (e.g. triphenylthiophosphate) and dithiophosphates, phosphites and phosphonates (e.g. di-n-octyl phosphonate), phosphates (e.g. substituted triphenyl phosphates or amine-neutralised alkyl phosphates), inorganic or organic boron compounds, thiocarbamates and dithiocarbamates (e.g. methylene bis(dibutyl dithiocarbamate));

corrosion protection agents such as sulphonates, e.g. petroleum sulphonate, dinonyl naphthalene sulphonate; neutral or overbased calcium sulphonates, magnesium sulphonates, sodium sulphonates, calcium and sodium naphthalene sulphonates, sulphonic acid esters, amine phosphates; N-methyl-N-(1-oxo-9-octadecenyl)glycine;

metal deactivators such as benzotriazoles, e.g. methylbenzotriazole dialkylamine, sterically hindered phenols, sodium nitrite;

viscosity improvers such as polymethacrylate, polyisobutylene, polystyrene;

friction reducers, some with anti-wear properties such as organic acids (e.g. isostearic acid), fatty acid esters of polyols that may be partially ethoxylated such as glycerol or sorbitan, partial glycerides, animal or vegetable oils, dialkyl hydrogen phosphonates, carboxylic acid amides such as oleyl amides, organic compounds based on polyethers and amides, e.g. alkyl polyethylene glycol tetradecylene glycol ethers, alkyl succinates, PIBSI (polyisobutylene succinimide) or PIBSA (polyisobutylene succinic anhydride).

solids: The use of particles (boron nitride, silicon dioxide, sheet silicates such as bentonite, carbon nanotubes) is possible in gear oils in order to achieve certain properties. Very small particles (so-called nanoparticles with particle sizes smaller than 500 nm, preferably smaller than 100 nm, particularly preferably smaller than 50 nm) are used in order to avoid negative effects with regard to tribological performance.

To prepare the lubricating fluid composition according to the invention, for example, a portion of the base oil (e.g. 5 to 25 wt. %) is introduced together with the additives, which are in particular oil-soluble but are generally present as solids under normal conditions, and heated to 90 to 110° C. with continuous stirring to ensure that these additives dissolve in the base oil. The temperature is reduced to less than 60° C. by adding a further portion of the base oil. Liquid and optionally oil-insoluble additives and solids as well as the remaining amount of base oil are then added and mixed with further stirring until the mixture is completely homogeneous.

The lubricating fluid composition according to the invention is particularly suitable for use in industrial gearboxes (spur, helical, bevel, spiral bevel and epicyclic gearboxes) and hydraulic systems, especially those used in the food or animal feedstuff industry.

A gearbox is a machine element with which movement variables (e.g. change in force, torque) can be changed. Depending on the design of the gearbox, it is surrounded by a housing and lubricated with a lubricating fluid. Seals are used to prevent the lubricating fluid from leaking out. In addition to special design properties, the sealing materials must also be chemically stable against the lubricating fluids used.

Elastomer compatibility therefore plays an important role in the development of lubricants. The same applies to the resistance of hydraulic seals, which are used to seal hydraulic systems filled with hydraulic oils.

As part of the present invention, a lubricating fluid was developed for use as a gear and hydraulic oil which fulfils the requirements of DIN 51517-3 (more precisely: the tests described in DIN ISO 1817 for relative volume change, change in Shore A hardness, tensile strength and elongation at break) as well as the dynamic elastomer compatibility test (Freudenberg test specification FS PLM 111 0008).

EXPERIMENTAL EXAMPLES

Manufacture

Part of the base oil quantity (5-25%), in this case, the polar oil components, namely ester and polyalkylene glycol, is provided together with the additives, which are solid at room temperature, and heated to 90 to 110° C. with continuous stirring until a clear solution is obtained. The temperature is reduced to less than 60° C. by adding the remaining (unheated) base oil. The liquid additives are then added and mixed by further stirring for approx. 15 min until the mixture is completely homogeneous. After further cooling to temperatures below 40° C., the oil can be filled.

In addition to the listed base oil components, the formulations each contain an additive package.

The following substances were used:

PAO 6 Polyalphaolefin: Spectrasyn 6, ExxonMobil Chemical; Synfluid PAO 6 cSt, Chevron Phillips Chemical; Durasyn 166, Ineos Oligomers mPAO 150 Polyalphaolefin, metallocene catalysed: Spectrasyn Elite 150, ExxonMobil Chemical; Synfluid mPAO 150 cSt, Chevron Phillips Chemical di(2-ethylhexyl)sebacate Priolube 1856, Croda; Nycobase 20307 FG, Nyco; Lubricit DOS, Zschimmer&Schwarz polymer ester Ketjenlube 240, Italmatch polyalkylene glycol UCON OSP-32, DOW wear protection additive—additive (AW additive) amine-neutralised alkyl phosphate, Irgalube 349, BASF SE additive package triphenylphosphorothionate, phenolic antioxidant, aminic antioxidant, sorbitan monooleate, N-methyl-N-(1-oxo-9-octadecenyl)glycine, polydimethylsiloxane and benzotriazole derivative, whereby the sorbitan monooleate is the friction modifier used.

TABLE 1

| | 1 Comparison | 2 Comparison | 3 Comparison | 4 According to invention |
|---|---|---|---|---|
| PAO 6 [wt. %] | 43.99 | 40.99 | 39.79 | 36.79 |
| mPAO 150 [wt. %] | 54.60 | 54.60 | 49.60 | 49.60 |
| Di(2-ethylhexyl)sebacate [wt. %] | — | — | 2.00 | 2.00 |
| Polymer ester [wt. %] | — | — | 7.20 | 7.20 |
| Polyalkylene glycol [wt. %] | — | 3.0 | — | 3.0 |
| AW additive [wt. %] | 0.33 | 0.33 | 0.33 | 0.33 |
| Additive package [wt. %] | 1.08 | 1.08 | 1.08 | 1.08 |
| kV [$mm^2/s$] | 220 | 220 | 220 | 220 |
| VI | 178 | 179 | 178 | 179 |
| LAV [min] | 6.2 | 4.0 | 4.5 | 5.7 |
| Elastomer compatibility [ΔV %] | −5.7 | −0.5 | −0.7 | −0.3 |
| Corrosion protection against steel, synthetic seawater | fail | pass | pass | pass |
| FZG A/8.3/90, SKS | | greater than 12 | greater than 12 | greater than 12 |
| FE8, mw50/mk50 [mg] | | | | 1.0/168 |

The following methods were applied in Tables 1 and 2:

kV 40 [$mm^2/s$] kinematic viscosity at 40° C. determined according to DIN EN ISO 3104

VI viscosity index according to DIN ISO 2909

LAV air separation capacity at 75° C. determined according to DIN ISO 9120

Elastomer compatibility according to DIN ISO 1817, 168 h at 100° C. for 72 NBR 902

Corrosion protection against steel, synthetic seawater steel finger test according to DIN ISO 7120-B FZG A/8.3/90, SKS damage force level achieved in the FZG test A/8.3/90 in accordance with DIN ISO 14635-1

FE8, mw50/mk50 [mg] calculated wear values of the rolling elements/cage (50% probability of wear) in the FE8 test (D-7.5/80-80) in accordance with DIN 51819-3

Micropitting, profile deviation [μm] FVA 54, profile deviation according to LS 9

Micropitting, achieved FVA 54, achieved damage force level (SKS), rating damage force level, rating GFT=grey stain resistance high=high The polymer esters and polyalkylene glycol used are very suitable additives to the PAO oil, as they are able to maintain the high viscosity index. A higher viscosity index means a higher lubricating film thickness at operating temperature, which contributes to better wear protection.

A purely PAO-based formulation (test 1) does not offer sufficient elastomer compatibility. NBR elastomers shrink and can lead to leaks. Formulations containing either polyalkylene glycol (test 2) or esters (test 3) show only slight volume losses. The best result is achieved with a formulation that contains both ester and polyalkylene glycol (PAG) in addition to POA (test 4). Furthermore, corrosion protection against salt water cannot be guaranteed with the purely PAO-based formulation despite the same additives.

Compared to the ester-containing but polyalkylene glycol-free version (test 3), the air separation capacity is not improved in test 4.

TABLE 2

| | 5 | 6 | 4 |
|---|---|---|---|
| PAO 6 [wt. %] | 37.72 | 36.77 | 36.79 |
| mPAO 150 [wt. %] | 47.00 | 49.50 | 49.60 |
| Di(2-ethylhexyl)sebacate [wt. %] | 2.00 | 2.00 | 2.00 |
| Polymer ester [wt. %] | 12.00 | 7.20 | 7.20 |
| Polyalkylene glycol [wt. %] | — | 3.0 | 3.0 |
| AW additive [wt. %] | 0.20 | 0.45 | 0.33 |
| Remaining additive package [wt. %] | 1.08 | 1.08 | 1.08 |
| kV 40 [$mm^2/s$] | 220 | 220 | 220 |
| VI | 178 | 179 | 179 |
| LAV 75° C. [min] | | 5.5 | 5.7 |
| 72 NBR 902: ΔV [%] | | −0.4 | −0.3 |
| Steel finger test | pass | pass | pass |
| FZG A/8.3/90, SKS | 11 | greater than 12 | greater than 12 |
| FE8, mw50/mk50 | 0/227 | 2.0/71.4 | 1.0/168 |
| Micropitting [μm] | 6.2 | 7.7 | 6.8 |
| Micropitting, achieved damage force level, rating | SKS 10 GFT high | SKS 9 GFT medium | SKS 10 GFT high |

Test series 2 shows that, among the additives, the content of amine-neutralised alkyl phosphates plays a decisive role in passing or failing the important mechanical-dynamic tests. With a low content (test 5), a high grey stain resistance can be achieved even without the addition of polyalkylene glycol. However, only damage force level 11 can be achieved in the FZG test. With a higher content of amine phosphates and in the presence of polyalkylene glycol (test 6), a damage force level greater than 12 is achieved in the FZG test, but the grey stain load-bearing capacity is insufficient. The reduced amine phosphate content in test 4 can be compensated for by the oil-soluble polyalkylene glycol without any negative effects in the micropitting test.

The base oil mixture described here supports the anti-corrosion properties and elastomer compatibility of the lubricant and allows a balanced additive composition suitable for "food grade" lubricants, which fulfils the sometimes conflicting requirements.

The invention claimed is:

1. A base oil comprising 81-96 wt. % polyalphaolefins as being oligomers of C6 to C14 alpha-olefins;

2-15 wt. % polymer esters as being polymerisation product of one or more alpha/beta-unsaturated dicarboxylic acid diesters, wherein the alcohol groups have 3 to 10 carbon atoms, and C4 to C18 alpha-olefins; and 2-4 wt. % polyalkylene glycols obtainable from alkylene oxides, wherein the alkylene oxides comprise:

butylene oxide, or propylene oxide and at least one C4 to C8 alkylene oxide.

2. The base oil according to claim 1, wherein the polyalphaolefins, the polymer esters and the polyalkylene glycols together make up more than 90 wt. % of the base oil.

3. The base oil according to claim 1, wherein the one or more alpha/beta-unsaturated dicarboxylic acid diesters have alcohol groups that are linear or branched or both linear and branched mono-alcohol groups having 3 to 10 carbon atoms.

4. The base oil according to claim 1, wherein the one or more alpha/beta-unsaturated dicarboxylic acid diesters comprise dicarboxylic acid groups having 4 to 12 carbon atoms.

5. The base oil according to claim 1, wherein the alpha-olefins of the polymer esters have 10 to 16 carbon atoms.

6. The base oil according to claim 1, wherein the one or more alpha/beta-unsaturated dicarboxylic acid diesters are maleic acid diesters or fumaric acid diesters or are a mixture of a maleic acid diesters and fumaric acid diesters.

7. The base oil according to claim 1, wherein the molar ratio of the alpha-olefins to the one or more alpha/beta-unsaturated dicarboxylic acid diesters is 1.5:1 to 1:1.5.

8. The base oil according to claim 1, wherein the polymer esters have an average molecular weight of 1000 to 5000 g/mol as number average.

9. The base oil according to claim 1, wherein the polyalphaolefins are characterised by one or more of the following properties:

a) the polyalphaolefins are oligomers of one or more of 1-octene, 1-decene and 1-dodecene;

b) the degree of polymerisation of the polyalphaolefins is 3 to 25;

c) the polyalphaolefins have a viscosity of 4 to 300 $mm^2/s$ at 100° C.;

d) the polyalphaolefins are a hydrogenated oligomer;

e) the polyalphaolefins are an oligomer of 50 to 80 wt. % 1-decene and 50 to 20 wt. % 1-dodecene;

f) the polyalphaolefins are a mixture of oligomers, wherein at least one oligomer is produced by metallocene catalysis; and g) the polyalphaolefins are a mixture of oligomers with a viscosity of 4 to 100 $mm^2/s$ at 100° C. and oligomers with a viscosity of 50 to 300 $mm^2/s$ at 100° C.

10. The base oil according to claim 1, wherein the polyalphaolefins are or comprise a mixture of:

a1) oligomers of 1-decene and b1) oligomers of 1-octene; or where the polyalphaolefins are or comprise a mixture of a2) oligomers of 1-dodecene and b2) oligomers of 1-octene or of 1-decene or of 1-octene and 1-decene.

11. The base oil according to claim 10, wherein the polyalphaolefins are a mixture of oligomers a) and b) with 5-95 wt. % of oligomers a1), and 95-5 wt. % of oligomers b1);

or 5-95 wt. % of oligomers a2), and 95-5 wt. % of oligomers b2).

12. The base oil according to claim 1, wherein the polyalkylene glycols are obtainable from alkylene oxides, wherein the alkylene oxides comprise 30-70 mol % propylene oxide and 70-30 mol % $C_4$ to $C_8$ alkylene oxides.

13. A lubricating fluid composition comprising the base oil according to claim 1, and further one of the following:

amine-reacted alkyl phosphates;

or polyol mono-esters;

or amine-reacted alkyl phosphates and polyol mono-esters.

14. The lubricating fluid composition according to claim 13 comprising 0.01 to 2 wt. % of the amine-reacted alkyl phosphates;

or 0.01 to 2 wt. % of the polyol mono-esters;

or 0.01 to 2 wt. % of the amine-reacted alkyl phosphates and 0.01 to 2 wt. % of the polyol mono-esters.

15. The lubricating fluid composition according to claim 13, wherein the polyol mono-ester has an ester group being a C12 to C24 fatty acid group;

or the polyol mono-ester has an ester group being a C12 to C24 fatty acid group and the polyol mono-ester is ethoxylated.

16. The lubricating fluid composition according to claim 13, wherein the amine-reacted alkyl phosphates are phosphates reacted with at least C10 to C18 alkyl amines; or the amine-reacted alkyl phosphates are mono- or di-C1 to C12 alkyl phosphates reacted with at least C10 to C18 alkyl amines.

17. The lubricating fluid composition according to claim 13 being a hydraulic oil or a gear oil for use in the food processing industry and/or the feedstuff processing industry.

* * * * *